US008445797B2

(12) United States Patent
Li

(10) Patent No.: US 8,445,797 B2
(45) Date of Patent: May 21, 2013

(54) SAFETY INTERLOCKING DEVICE FOR A SWITCH

(75) Inventor: Di Nan Li, Suzhou (CN)

(73) Assignee: Siemens Aktiengesellschaft, Munich (DE)

( * ) Notice: Subject to any disclaimer, the term of this patent is extended or adjusted under 35 U.S.C. 154(b) by 323 days.

(21) Appl. No.: 12/869,015

(22) Filed: Aug. 26, 2010

(65) Prior Publication Data

US 2011/0048905 A1 Mar. 3, 2011

(30) Foreign Application Priority Data

Aug. 31, 2009 (CN) ..... 2009 1 0171623

(51) Int. Cl.
*H01H 9/28* (2006.01)

(52) U.S. Cl.
USPC ..... 200/43.16; 200/43.11; 200/50.01; 200/50.1; 200/50.12; 200/552

(58) Field of Classification Search
USPC ..... 200/43.16, 50.1, 50.12, 50.13
See application file for complete search history.

(56) References Cited

U.S. PATENT DOCUMENTS 4,137,433 A * 1/1979 Erickson et al. ..... 200/50.12
4,405,844 A * 9/1983 Dizon et al. ..... 200/50.12
4,489,362 A 12/1984 Castonguay
5,847,319 A 12/1998 Harbecke et al.

FOREIGN PATENT DOCUMENTS

CN 1163674 A 10/1997
CN 201199490 Y 2/2009

OTHER PUBLICATIONS

Chinese Office Action dated Jan. 22, 2013 for corresponding Chinese Application No. 200910171623.4.

* cited by examiner

*Primary Examiner* — Renee Luebke
*Assistant Examiner* — Lheiren Mae Caroc
(74) *Attorney, Agent, or Firm* — Harness, Dickey & Pierce, P.L.C.

(57) ABSTRACT

A safety interlocking device for a switch includes a supporting member, an annular member, a locking lever, a limiting rod and a resilient member. A driving shaft of the switch is arranged through the supporting member and the annular member, the annular member rotates synchronously with the driving shaft, and the annular member is coupled to a wing block. The locking lever is hooked onto the safety device, the limiting rod is rotated when pushed by the safety device, and the rotation of the limiting rod rotates the locking lever. When the safety device is closed, the switch is turned on and the locking lever hooks onto the safety device so that the latter cannot be opened; and when the switch is turned off, the locking lever releases the safety device, while one end of the limiting rod limits the rotation of the annular member, thus limiting the switch's turn-on operation.

9 Claims, 3 Drawing Sheets

SAFETY INTERLOCKING DEVICE FOR A SWITCH

PRIORITY STATEMENT

The present application hereby claims priority under 35 U.S.C. §119 on Chinese patent application number CN 200910171623.4 filed Aug. 31, 2009, the entire contents of which are hereby incorporated herein by reference.

TECHNICAL FIELD

At least one embodiment of the present invention generally relates to a safety interlocking device for a switch and, particularly, to a safety interlocking device between a safety device (e.g. a fuse cover) and a driving shaft of a switch.

BACKGROUND ART

A switch safety device can provide a safe and economical protection measure for a switch, for example, a switch with a fuse provides a safe and economical short-circuit protection by means of a fuse: in case of a short circuit, the fuse is melted, and the user only needs to replace the fuse, and then the switch is back in operation again. However, danger may occur if a user operates on the fuse when the main contacts of the switch are connected. Currently, in existing switches, a fuse cover is provided as a safety device to protect an operator when replacing the fuse, and the fuse cover is mechanically connected to the driving shaft of the switch to protect the operator's fingers from getting hurt by the fuse. When the switch is turned on, the fuse cover can protect the fuse and the fuse cover is locked, in this way the fuse cannot be replaced, so the safety of the operator is ensured.

U.S. Pat. No. 4,489,362 proposes a switch with a fuse interlocking device, in which the fuse interlocking device comprises a resetting spring, a locking lever, a shaft pin and a bearing groove, and when the switch is connected, the fuse interlocking device ensures that the fuse cover cannot be opened and the operator cannot operate the fuse. However, a drawback of similar safety devices is that when the fuse cover of the switch is opened, locking of the switch drive is not ensured, and the operator will still face a risk if the switch is turned on accidently during the replacement of the fuse.

SUMMARY

In at least one embodiment, the present invention aims at providing a safety interlocking device for a switch; the device can ensure not only that a safety device cannot be opened before the switch is turned off, but also that an operator cannot turn the switch on before the safety device has returned to a safe position, thus realizing complete protection.

In at least one embodiment, a safety interlocking device for a switch comprises:

a supporting member which can be arranged through a switch driving shaft;

an annular member, with the middle part of the annular member being provided with a shaft hole which can accommodate the driving shaft of the switch, and the outer periphery of the annular member being provided with a wing block;

a locking lever, the locking lever comprising:

a locking hook, with the locking hook being capable of hooking onto a safety device connected to the safety interlocking device;

a locking pivot shaft fixed on said supporting member, with the locking lever being rotatable around the locking pivot shaft;

a locking lever driving end;

a limiting rod, the limiting rod comprising:

a limiting end, with the safety device being capable of abutting against the limiting end, so as to push the limiting rod to rotate;

a limiting pivot shaft fixed on the supporting member, with the locking lever being rotatable around the limiting pivot shaft;

a limiting rod driving end, with the limiting rod driving end being connected to the locking lever driving end and being capable of making the locking lever driving end move; so that when the switch is at the turn-on position, the limiting rod driving end abuts against the outer periphery of the wing block; and when the switch is at the turn-off position, the limiting rod driving end abuts against the end face of the wing block; and a resilient member, with one end of the resilient member being connected to a limiting member disposed on the supporting member, and the other end being connected to the limiting rod.

In another safety interlocking device for a switch according to at least one embodiment of the present invention, the locking lever and the limiting rod are two L-shaped rods disposed opposite to each other, the locking pivot shaft is disposed at the turning point of the L-shaped locking lever, and the limiting pivot shaft is disposed at the turning point of the L-shaped limiting rod.

In another safety interlocking device for a switch according to at least one embodiment of the present invention, the limiting rod driving end has a groove and a limiting boss; the locking lever driving end is located in the groove of the limiting rod driving end; when the switch is at the turn-on position, the limiting boss abuts against the outer periphery of the wing block; and when the switch is at the turn-off position, the limiting boss abuts against the end face of the wing block.

In yet another safety interlocking device for a switch according to at least one embodiment of the present invention, the resilient member can be one of a torsional spring, a compression spring, a tension spring or a leaf spring, one end of the resilient member is connected to the limiting member, and the other end is connected to the limiting pivot shaft of the limiting rod. Furthermore, the limiting member therein can be a limiting pin.

In another safety interlocking device for a switch according to at least one embodiment of the present invention, the resilient member can be a resilient strip, the resilient strip extends from the limiting rod, and its free end abuts against the limiting member.

In another safety interlocking device for a switch according to at least one embodiment of the present invention, on the annular member there are disposed two of said wing blocks radially symmetrically.

In another safety interlocking device for a switch according to at least one embodiment of the present invention, the safety device is a fuse cover.

The safety interlocking device of at least one embodiment of the present invention has realizes the interlocking of the safety device and the switch driving shaft by way of the cooperation between the locking lever, the limiting rod, the annular member, the spring, etc., and it is capable of fulfilling the following safety requirements:

before an operator can remove the safety device, he has to set the switch to the turn-off position, otherwise the safety device cannot be opened; and before the safety device has been returned to a proper safe position, the operator cannot put the switch to the turn-on position.

The above two features effectively protect the safety of the operator and, furthermore, the safety interlocking device is simple in structure and easy to produce, and it can be mounted either at one side or at both sides of a switch, making the interlocking function more stable; it can meet various requirements for use.

BRIEF DESCRIPTION OF THE DRAWINGS

The following figures are only for illustrative description and explanation of embodiments of the present invention and are not to limit the scope of the present invention, in which.

DESCRIPTION OF REFERENCE NUMERALS

Figure 1:
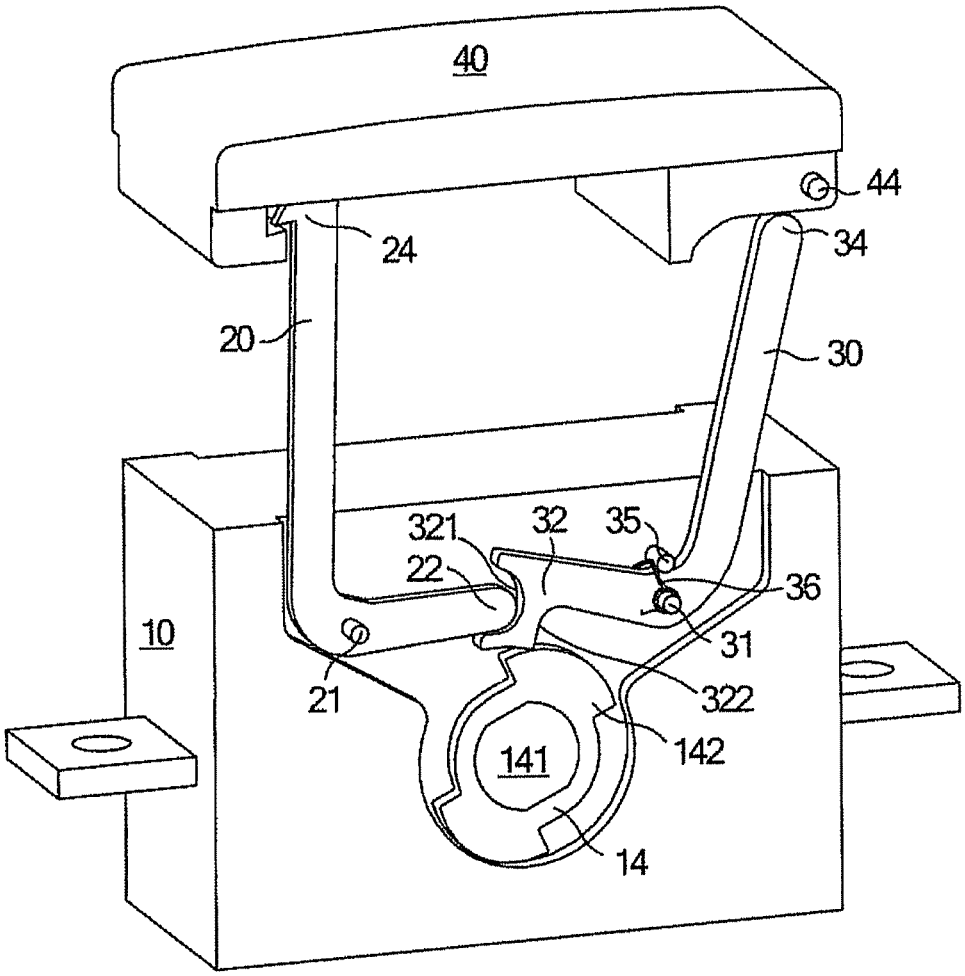
FIG. 1 is a schematic structural view of the safety interlocking device for a switch of an embodiment of the present invention.

| | | | | | | | |
|---|---|---|---|---|---|---|---|
| 10 | supporting member | 14 | annular member | 141 | shaft hole | 142 | wing block |
| 20 | locking lever | 21 | locking pivot shaft | 22 | locking lever driving end | 24 | locking hook |
| 30 | limiting rod | 31 | limiting pivot shaft | 32 | limiting rod driving end | 34 | limiting end |
| 35 | limiting member | 36 | resilient member | 321 | groove | 322 | limiting boss |
| 40 | safety device | 44 | pivot shaft | | | | |

In order to understand the technical features, objects and effects of the present invention more clearly, the particular embodiments of the present invention are described here with reference to the accompanying drawings, in which the same numerals in the figures represent the same parts.

DETAILED DESCRIPTION OF THE EXAMPLE EMBODIMENTS

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

it will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 is a schematic structural view of the safety interlocking device for a switch of an embodiment of the present invention. The safety interlocking device is installed in cooperation with the switch safety device 40, and the safety device 40 is rotatable around its pivot shaft 44. For example, in a particular embodiment of the present invention, the safety device 40 can be a fuse cover, and the switch fuse is located under the fuse cover. In case the fuse is burnt out and needs to be replaced, an operator can open the fuse cover, then he can carry out the corresponding operations. However, it can be recognized by those skilled in the art that it is not only the fuse cover which can cooperate with the interlocking device of the present invention, it can also be other safety devices in a switch.

As shown in FIG. 1, the safety interlocking device for a switch comprises a supporting member 10, an annular member 14, a locking lever 20, a limiting rod 30 and a resilient member 36. A switch driving shaft can pass through the middle part of the supporting member 10, so that the switch's turn-on or turn-off operation can be accomplished by rotating the driving shaft. The middle part of the annular member 14 is provided with a shaft hole 141 which can accommodate the switch driving shaft, the switch driving shaft can pass through the shaft hole 141, and the shape of the shaft hole is adapted to that of the driving shaft, so that they can realize the synchronized rotation of the annular member 14 and the switch driving shaft. The outer periphery of the annular member has a wing block, and of course, those skilled in the art would be able to understand that for the convenience of manufacturing and stability of the interlock function, two wing blocks 142 can be disposed symmetrically at the outer periphery of the annular member 14 as shown in FIG. 1.

The locking lever 20 comprises a locking hook 24, a locking lever driving end 22 and a locking pivot shaft 21 fixed on the supporting member 10, and the locking lever 20 is rotatable around the locking pivot shaft 21. When the safety device 40 is closed, the locking hook 24 of the locking lever 20 can hook onto the edge of the safety device 40, so as to lock the safety device 40, meaning the safety device 40 is in a safe position and an operator cannot open the safety device. Although in the particular embodiment as shown in the figures the locking lever 20 has an L-shape and the locking pivot shaft is at the turning point of this L-shape, it can be understood by those skilled in the art that the locking lever 20 can be of other suitable shapes.

The limiting rod 30 comprises a limiting end 34, a limiting rod driving end 32 and a limiting pivot shaft 31 fixed on the supporting member 10, and the locking lever 30 is rotatable around the limiting pivot shaft 31. During the closing of the safety device 40, the limiting end 34 at one end of the limiting rod 30 is pushed by the safety device 40, thus causing the limiting rod 30 to rotate, and the limiting rod driving end 32 at the other end of the limiting rod 30 makes the locking lever driving end 22 connected therewith rotate. Although in the particular embodiment shown in the figures the limiting rod 30 has a symmetrical L-shape and the limiting pivot shaft is at the turning point of the L shape, it can be understood by those skilled in the art that the limiting rod 30 can be of other suitable shapes.

One end of the resilient member 36 is connected to the limiting rod 30, and the other end is connected to the limiting member 35 disposed at the supporting member. In the particular embodiment shown in FIG. 1, the resilient member 36 is a torsional spring, which is sleeved onto the limiting pivot shaft 31 of the limiting rod 30, thus realizing the connection between the resilient member 36 and the limiting rod 30; and one end of the resilient member abuts against the limiting member 35. Of course, those skilled in the art can understand that the resilient member 36 can be a torsional spring, or one of a compression spring, a tension spring or a leaf spring; or the resilient member 36 can be a resilient strip which extends directly from the limiting rod 30, and the free end of the resilient strip abuts against the limiting member 35. Furthermore, the limiting member 35 can be designed either as a limiting pin as shown in the figure or to have any other suitable shape. Although only the resilient member connected to the limiting rod 30 is depicted in the particular embodiment shown in FIG. 1, it can be understood by those skilled in the art that the locking lever 20 can also be connected to a resilient member.

In the particular embodiment shown in FIG. 1, the limiting rod driving end 32 has a groove 321, the locking lever driving end 22 is located in the groove 321, and the locking lever driving end 22 can both move with the limiting rod driving end 32 and have slight relative movement in the groove 321. The limiting rod driving end 32 further has a limiting boss 322, and the limiting boss 322 can both move along the outer periphery of the wing block 142 and abut against the end face of the wing block 142. This structure realizes the movement of the locking lever driving end 22 following that of the limiting rod driving end 32. Of course, those skilled in the art can understand that the way of realizing the movement of the locking lever driving end 22 following that of the limiting rod driving end 32 is not restricted to this single way, and any other suitable way can be used in an embodiment of the present invention.

Although the safety interlocking device is provided at only one side of the supporting member 10 in FIG. 1, in practical applications a set of safety interlocking devices can be provided symmetrically at two opposite sides of the supporting member 10 according to various safety requirements, so as to improve their operational stability and safety.

The operation process of the safety interlocking device shown in FIG. 1 is described in detail hereinbelow in conjunction with FIGS. 2 to 5.

Figure 2:
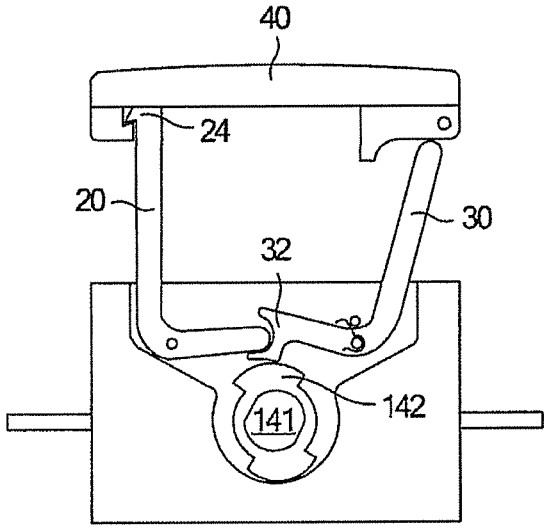
FIG. 2 is a schematic view of the operation of the safety interlocking device when the switch is in the turn-on state and the safety device is closed.

FIG. 2 shows a schematic view of the operation of the safety interlocking device for a switch of an embodiment of the present invention when the switch is turned on. As shown in FIG. 2, when the switch is in the turn-on state, the switch driving shaft brings the shaft hole 141 to the position shown, meaning the limiting rod driving end 32 of the limiting rod 30 abuts against the outer periphery of the wing block 142, and the locking hook 24 of the locking lever 20 is engaged in the safety device 40, and in this way the safety device 40 cannot be opened. If the safety device 40 needs to be opened, the switch needs to be at the turn-off position first, so as to ensure operational safety.

Figure 3:
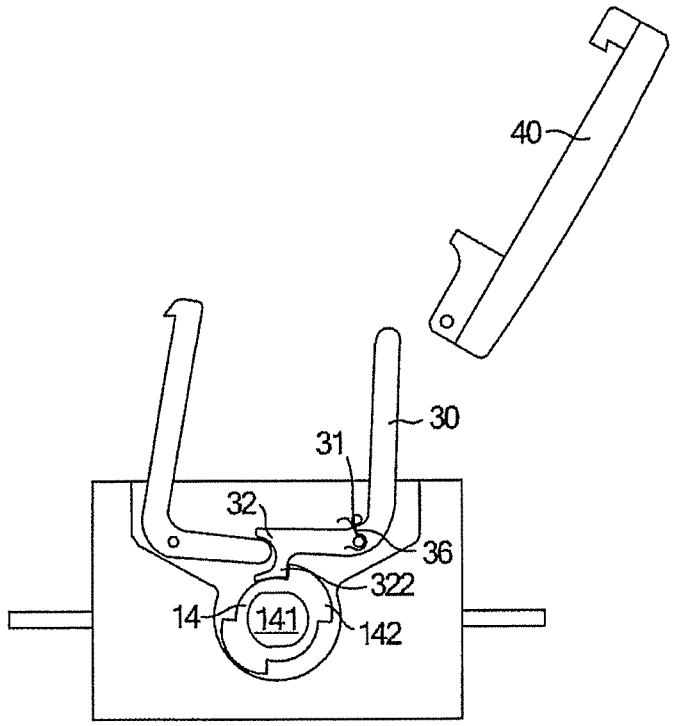
FIG. 3 is a schematic view of the operation of the safety interlocking device when the switch is in the turn-off state and the safety device is opened.

FIG. 3 shows a schematic view of the operation of the safety interlocking device when the switch driving shaft is in the turn-off status and the safety device 40 is open. After the driving shaft has already been at the turn-off position, the shaft hole 141 is in the position shown in FIG. 3, and the operator can operate the safety device as needed. At this time, under the resilient force of the resilient member 36, the limiting rod 30 rotates counterclockwise around the limiting pivot shaft 31 to make the limiting boss 322 of the limiting rod driving end 32 abut against one end face of the wing block 142, thus limiting the counterclockwise rotation of the annular member 14. The annular member 14 is tightly sleeved on the switch driving shaft, therefore the driving shaft cannot be rotated to carry out the turn-on operation. The process described above shows that the switch cannot be turned on when the safety device 40 is open, therefore ensuring the safety of the operator.

Figure 4:
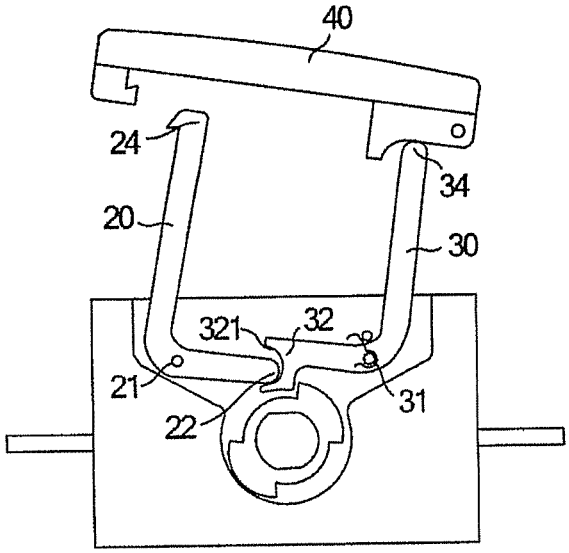
FIG. 4 is a schematic view of the operation of the safety interlocking device when the switch is in the turn-off state and the safety device is going to be closed.

FIG. 4 shows a schematic view of the operation of the safety interlocking device when the switch driving shaft is at the turn-off position and the safety device 40 is going to be closed. As the safety device 40 is in the process of being closed, the safety device 40 abuts against the limiting end 34 of the limiting rod 30 and starts to push the limiting end 34 clockwise to rotate the limiting rod 30 around the limiting pivot shaft 31, thus making the limiting rod driving end 32 move upwards therewith. At this moment, the groove 321 on the limiting rod driving end 32 also moves upwards to make at the same time, the limiting rod driving end 22 of the limiting rod move upwards, thus rotating the limiting rod 20 counterclockwise around the locking pivot shaft 21 and making the locking hook 24 move along the locking direction of the safety device 40.

Figure 5:
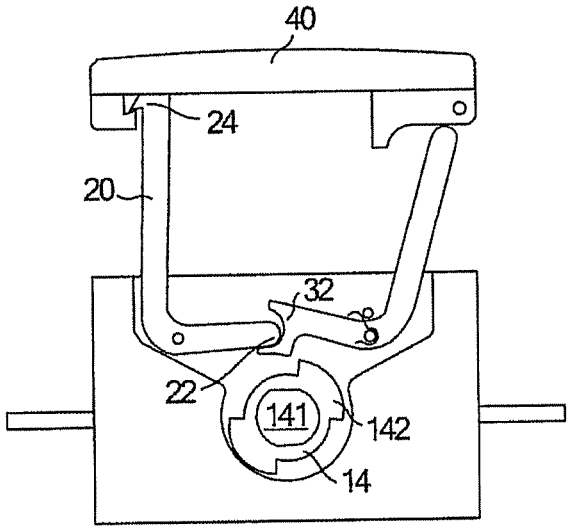
FIG. 5 is a schematic view of the operation of the safety interlocking device when the switch is in the turn-off state and the safety device is closed.

FIG. 5 shows a schematic view of the operation of the safety interlocking device when the switch driving shaft is still at the turn-off position and the safety device 40 is fully closed. When the safety device 40 is fully closed, the locking hook 24 of the locking lever 20 is moved to the position where it just engages the safety device 40. At this moment, under the push of the safety device 40, the positions of both the limiting rod driving end 32 and the locking lever driving end 22 are elevated and they no longer abut against the end face of the wing block 142, therefore the driving shaft can make the annular member 14 rotate, bringing it together into the turn-on position as shown in FIG. 2.

Then the operational procedure of the safety interlocking device goes back to the status shown in FIG. 2.

As described above, the safety interlocking device in an embodiment of the present invention meets the following safety requirements: before an operator removes the safety device, the operator has to put the switch to the turn-off position, otherwise the safety device 40 cannot be opened; and after the safety device 40 has been opened, the operator cannot put the switch to the turn-on position until the safety device is mounted to the correct position. At the same time, the safety interlocking device in the present invention is simple in structure and easy to produce, and can be installed either at one side or at both sides of the switch to achieve better stability and to meet various requirements for use.

In the descriptions of the operational process of the safety interlocking device for a switch, although the safety device mentioned herein rotates around a pivot shaft, in practical applications, such safety devices can also adopt vertical movements, and as long as the safety devices can push the limiting rod clockwise when closed, the above safety requirements can be fulfilled.

The series of detailed descriptions set forth above are only specific descriptions directed at feasible embodiments of the present invention, and are not intended to limit the protective scope of the present invention; and all the equivalent embodiments or modifications made without departing from the technical spirit of the present invention should be included in the protective scope of the present invention.

The invention claimed is:

1. A safety interlocking device for a switch, comprising:

a supporting member, configured to be arranged through a driving shaft of the switch;

an annular member including a middle part with a shaft hole configured to accommodate said driving shaft of the switch, an outer periphery of the annular member coupled to a wing block;

a locking lever comprising:

a locking hook, a locking lever driving end, and a locking pivot shaft configured to fix onto said supporting member, the locking lever being rotatable around said locking pivot shaft and said locking hook being configured to hook on a safety device connected to said safety interlocking device;

a limiting rod comprising:

a limiting end, a limiting rod driving end including a groove and a limiting boss, said locking lever driving end being configured to be located in said groove upon said switch being at the turn-on position, said limiting boss being configured to abut against the outer periphery of said wing block and upon said switch being at the turn-off position, said limiting boss being configured to abut against the end face of said wing block, and a limiting pivot shaft configured to fix onto said supporting member, said limiting rod being rotatable around said limiting pivot shaft, wherein said safety device is configured to abut against said limiting end to push said limiting rod to rotate, said limiting rod driving end being configured to connect to said locking lever driving end and being configured to make said locking lever driving end move so that, upon said switch being at the turn-on position, said limiting rod driving end is configured to abut against the outer periphery of said wing block and upon said switch being at the turn-off position, said limiting rod driving end being configured to abut against the end face of said wing block; and a resilient member, one end of the resilient member being configured to connect to a limiting member disposed on said supporting member, and the other end being configured to connect to said limiting rod.

2. The safety interlocking device for a switch as claimed in claim 1, wherein said resilient member is a resilient; strip extending from said limiting rod, and a free end of said resilient strip abuts against said limiting member.

3. The safety interlocking device for a switch as claimed in claim 1, wherein said safety device is a fuse cover.

4. A switch comprising the safety interlocking device of claim 1.

5. A safety interlocking device for a switch, comprising:

a supporting member, configured to be arranged through a driving shaft of the switch;

an annular member including a middle part with a shaft hole configured to accommodate said driving shaft of the switch, an outer periphery of the annular member coupled to a wing block;

a locking lever comprising:

a locking hook, a locking lever driving end, and a locking pivot shaft configured to fix onto said supporting member, the locking lever being rotatable around said locking pivot shaft and said locking hook being configured to hook on a safety device connected to said safety interlocking device;

a limiting rod comprising:

a limiting end, a limiting rod driving end, and a limiting pivot shaft configured to fix onto said supporting member, said limiting rod being rotatable around said limiting pivot shaft, wherein said safety device is configured to abut against said limiting end to push said limiting rod to rotate, said limiting rod driving end being configured to connect to said locking lever driving end and being configured to make said locking lever driving end move so that, upon said switch being at the turn-on position, said limiting rod driving end is configured to abut against the outer periphery of said wing block and upon said switch being at the turn-off position, said limiting rod driving end being configured to abut against the end face of said wing block; and a resilient member, one end of the resilient member being configured to connect to a limiting member disposed on said supporting member, and the other end being configured to connect to said limiting rod, said resilient member being at least one of a torsional spring, a compression spring, a tension spring or a leaf spring, one end of said resilient member being connected to said limiting member, and another end of said resilient member being connected to said limiting pivot shaft of said limiting rod.

6. The safety interlocking device for a switch as claimed in claim 5, wherein said limiting member is a limiting pin.

7. A safety interlocking device for a switch, comprising:

a supporting member, configured to be arranged through a driving shaft of the switch;

an annular member including a middle part with a shaft hole configured to accommodate said driving shaft of the switch, an outer periphery of the annular member coupled to two wing blocks disposed radially symmetrically;

a locking lever comprising:

a locking hook, a locking lever driving end, and a locking pivot shaft configured to fix onto said supporting member, the locking lever being rotatable around said locking pivot shaft and said locking hook being configured to hook on a safety device connected to said safety interlocking device;

a limiting rod comprising:

a limiting end, a limiting rod driving end, and a limiting pivot shaft configured to fix onto said supporting member, said limiting rod being rotatable around said limiting pivot shaft, wherein said safety device is configured to abut against said limiting end to push said limiting rod to rotate, said limiting rod driving end being configured to connect to said locking lever driving end and being configured to make said locking lever driving end move so that, upon said switch being at the turn-on position, said limiting rod driving end is configured to abut against the outer periphery of at least one of said two wing blocks and upon said switch being at the turn-off position, said limiting rod driving end being configured to abut against the end face of at least one of said two wing blocks; and a resilient member, one end of the resilient member being configured to connect to a limiting member disposed on said supporting member, and the other end being configured to connect to said limiting rod.

8. A safety interlocking device for a switch, comprising:

a supporting member configured to be arranged through a driving shaft of the switch;

an annular member including a middle part with a shaft hole configured to accommodate said driving shaft of the switch, an outer periphery of the annular member coupled to a wing block;

an L-shaped locking lever rod comprising:

a locking hook, a locking lever driving end, and a locking pivot shaft configured to dispose at a turning point of said L-shaped locking lever rod and to fix onto said supporting member, the L-shaped locking lever rod being rotatable around said locking pivot shaft and said locking hook being configured to hook on a safety device connected to said safety interlocking device;

an L-shaped limiting rod disposed opposite to the L-shaped locking lever, the L-shaped limiting rod comprising:

a limiting end, a limiting rod driving end including a groove and a limiting boss, said locking lever driving end being configured to be located in said groove, upon said switch being at the turn-on position, said limiting boss is configured to abut against the outer periphery of said wing block and upon said switch being at the turn-off position, said limiting boss being configured to abut against the end face of said wing block, and a limiting pivot shaft configured to dispose at a turning point of said L-shaped limiting rod and fix onto said supporting member, said limiting rod being rotatable around said limiting pivot shaft, wherein said safety device is configured to abut against said limiting end to push said limiting rod to rotate, said limiting rod driving end being configured to connect to said locking lever driving end and being configured to make said locking lever driving end move so that, upon said switch being at the turn-on position, said limiting rod driving end is configured to abut against the outer periphery of said wing block and upon said switch being at the turn-off position, said limiting rod driving end being configured to abut against the end face of said wing block; and a resilient member, one end of the resilient member being configured to connect to a limiting member disposed on said supporting member, and the other end being configured to connect to said limiting rod.

9. A switch comprising the safety interlocking device of claim 8.

* * * * *